United States Patent [19]

Reed

[11] Patent Number: 4,783,177

[45] Date of Patent: Nov. 8, 1988

[54] SEALS FOR SEALING OPENINGS FORMED BY SLITS

[75] Inventor: Norman L. Reed, Ashford, United Kingdom

[73] Assignee: Airflex Containers Ltd., Ashford, United Kingdom

[21] Appl. No.: 63,460

[22] Filed: Jun. 18, 1987

[30] Foreign Application Priority Data

Jun. 18, 1986 [GB] United Kingdom ..... 8614807

[51] Int. Cl.[4] ..... B65D 33/16; B65D 77/10

[52] U.S. Cl. ..... 383/81; 150/52 K; 206/3; 206/335

[58] Field of Search ..... 52/2 B, 2 R, 2 F; 150/52 K, 52 R; 89/34; 206/3, 335, 524.8; 383/3, 42–46, 48–51, 58, 62, 63–65, 68, 69, 78–83, 100, 101, 103

[56] References Cited

U.S. PATENT DOCUMENTS

| | | | |
|---|---|---|---|
| 2,514,364 | 7/1950 | Bates | 206/3 |
| 2,608,198 | 8/1952 | Goodman | 150/52 K |
| 2,943,760 | 7/1960 | Hamilton . | |
| 3,221,921 | 12/1965 | Silverman . | |
| 3,710,997 | 1/1973 | Asikainen | 206/3 |
| 3,929,178 | 12/1975 | Hickey | 150/52 K |
| 4,114,668 | 9/1978 | Hickey | 150/52 R |
| 4,140,191 | 2/1979 | Hickey | 150/52 K |
| 4,261,401 | 4/1981 | Hickey | 150/52 K |
| 4,306,665 | 12/1981 | Hickey | 150/52 R |

FOREIGN PATENT DOCUMENTS

| | | | |
|---|---|---|---|
| 0090616 | 10/1983 | European Pat. Off. . | |
| 1586978 | 8/1970 | Fed. Rep. of Germany . | |
| 0134074 | 3/1985 | United Kingdom | 206/335 |

*Primary Examiner*—Jimmy G. Foster
*Attorney, Agent, or Firm*—Young & Thompson

[57] ABSTRACT

A seal for reusably sealing an opening formed by a slit in a sheet material portion of an envelope providing an airtight enclosure, which seal comprises an edge formation having first and second flexible members secured along respective first and second edge portions of the slit, a rigid member extending along the length of the slit and having a channel along its length for receiving and holding therein the first and second flexible members in contact with one another so as to close the opening, inflatable means operable upon inflation thereof to urge the first and second flexible members into sealing engagement with one another and to secure the first and second members within the channel of the rigid member, and retaining means for resisting withdrawal of the first and second flexible members from the channel whilst the inflatable means is deflated. The retaining means simplifies the alignment of the flexible members prior to inflation. The seal is useful in an evacuatable envelope for storage of weapons or vehicles.

10 Claims, 3 Drawing Sheets

SEALS FOR SEALING OPENINGS FORMED BY SLITS

Figure 1:
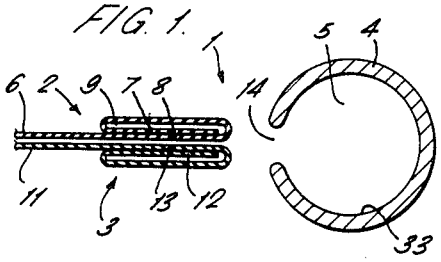

This invention relates toa seal for reusably sealing an opening formed by a slit in a sheet material portion of an envelope providing an airtight enclosure. It is known for airtight enclosures to be used for the storage of goods and for restraining movement of goods during transit by evacuating the enclosure to collapse the envelope into restraining contact with the goods.

It is also known for such envelopes to include a sheet material portion having a sealable slit opening which may for example provide an access port of the enclosure for inspection or maintenance of the goods. Known seals for such slit openings provide a metallic clamp for holding edge portions of the sheet material in sealing contact and such seals have been found to be unsatisfactory in that they are not sufficiently airtight.

According to the present invention there is disclosed a seal for reusably sealing an opening formed by a slit in a sheet material portion of an envelope providing an airtight enclosure, which seal comprises an edge formation having first and second flexible members secured along respective first and second edge portions of the slit, a rigid member extending along the length of the slit and having a channel along its length for receiving and holding therein the first and second flexible members in contact with one another so as to close the opening, inflatable means operable upon inflation thereof to urge the first and second flexible members into sealing engagement with one another and to secure the first and second members within the channel of the rigid member, and retaining means for resisting withdrawal of the first and second flexible members from the channel whilst the inflatable means is deflated.

Preferably the retaining means is constituted by the channel having a mouth which is narrower than the combined thickness of the first and second flexible members so that insertion or withdrawal of the members to respectively close or open the opening requires resilient deformation of at least one of the flexible members.

Preferably the inflatable means comprises a flexible tube formed integrally with the first flexible member. Advantageously the first flexible member comprises a first sheet of flexible material and the tube is formed by bonding an edge strip of the first sheet to a further strip inboard of the edge strip such that the thickness of the deflated tube is substantially three times the thickness of the first sheet.

Preferably the second flexible member comprises a second sheet of flexible material and is formed by bonding an edge strip of the second sheet to a further strip inboard of the edge portion such that the thickness of the member is substantially three time the thickness of the second sheet.

Preferably a seal for use with a discontinuous slit has a first and second end wherein the first and second flexible members extend beyond the first and second ends respectively to form extended portions in which the flexible members are bonded to one another.

Conveniently the seal includes valve means for inflating or deflating the inflatable means, which valve means is accessible through an aperture in the rigid member.

According to a further aspect of the present invention there is disclosed an envelope including an opening sealable by means of a seal as hereinbefore disclosed and having envelope valve means controlling an outlet of air from within the envelope whereby goods may be inserted through the opening, the opening may then be sealed and suction then applied to the envelope valve means so as to collapse the envelope into contact with the goods.

Conveniently the opening in such an envelope is formed by a discontinuous slit defining a flap closure for an access port of the enclosure.

According to a further aspect of the present invention there is disclosed a method of sealing an opening formed by a slit in a sheet material portion of an envelope providing an airtight enclosure including the step of applying an edge formation such that first and second flexible members of the formation are secured along respective first and second edge portions of the slit, which edge formation is co-operable with a rigid member to form a reusable seal of the type hereinbefore disclosed.

Figure 2:
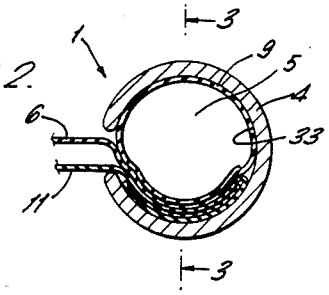
Figure 3:
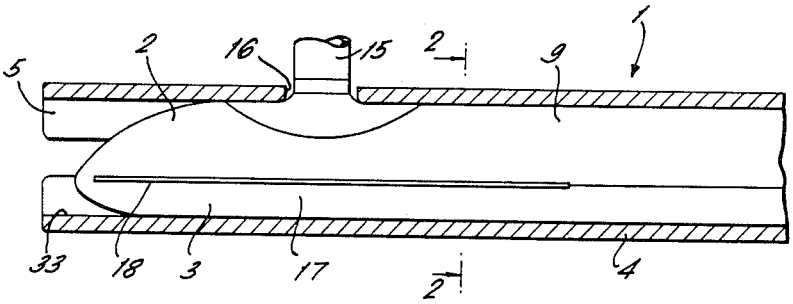
Figure 4:
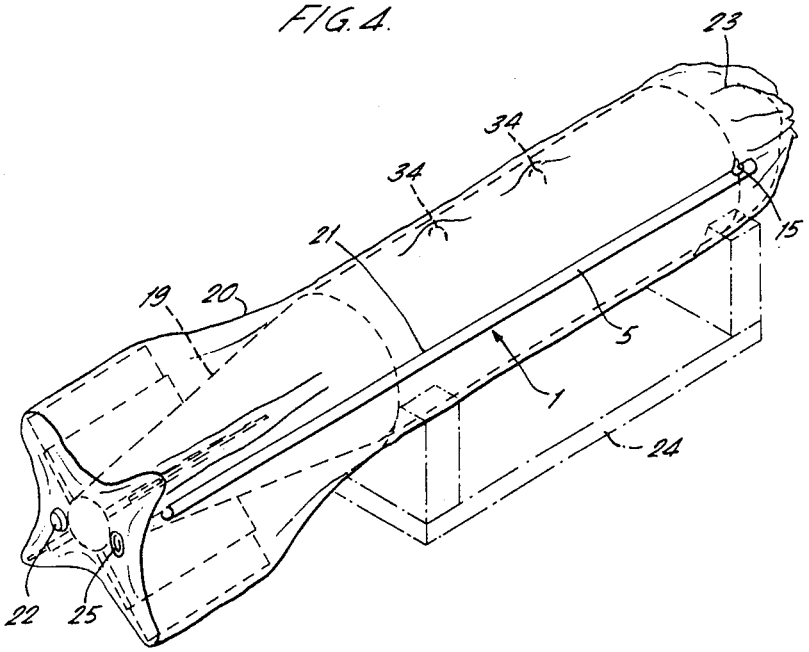

Particular embodiments of the invention will now be described by way of example only and with reference to the accompanying drawings of which, FIG. 1 is a sectional view of a seal prior to insertion of the first and second flexible members into the channel of a rigid member, FIG. 2 is a similar view of the seal of FIG. 1 after insertion of the flexible members and inflation of the inflatable means, FIG. 3 is a part cut away side view of the seal of FIG. 2, FIG. 4 is a perspective view of an enclosure containing a weapon store and having a seal of the type shown in FIGS. 1 to 3, and FIG. 5 is a perspective view of an enclosure for a vehicle having slit openings which are sealed by seals of the above type.

FIG. 1 shows a seal 1 having first and second flexible members 2 and 3 respectively and a rigid member 4 defining a channel 5.

The first flexible member 2 comprises a first sheet 6 of elastomeric material having an edge strip 7 which is bonded to a further strip 8 inboard of the edge strip to form a tube 9. The tube 9 is inflatable but in FIG. 1 is shown in its deflated state in which the thickness of the first flexible member 2 is three times the thickness of the first sheet 6.

The second flexible member 3 comprises a second sheet 11 of elastomeric material having an edge strip 12 which is bonded to a further strip 13 inboard of the edge strip such that a thickness of the second flexible member is three times the thickness of the second sheet 11.

The rigid member 4 is C shaped in cross section so as to form a channel 5 having a longitudinally extending mouth 14 which is narrower than the combined thickness of the first and second flexible members 2 and 3.

In FIG. 2 the first and second flexible members 2 and 3 are located within the channel 5 with the tube 9 is inflated.

In FIG. 3 the inflated tube 9 is seen to have a shrader valve 15 for inflation and deflation of the tube and this valve extends through an aperture 16 in the rigid member formed as a keyhole slot communicating with the mouth 14 so as to facilitate insertion and removal of the tube with respect to the rigid member 4. The first and second flexible members 2 and 3 are bonded together at each end by a vulcanising process to form an extended portion 17 at each end along which a seam 18 extends at the bonded interface between the respective members.

The tube is seen in FIG. 3 to be closed at the end of the extended portion 17 and the valve 15 is located within this extended portion. The second flexible member 3 is of similar construction to the first flexible member 2 having closed ends but not including a valve.

FIG. 4 shows a weapon store 19 which is covered by an envelope 20 of flexible sheet material. A linear slit 21 extends lengthwise along the envelope 20 and is closed by a seal 1 of the type shown in FIGS. 1, 2 and 3. The envelope 20 has an evacuation valve 22 for connection to a suction means (not shown) so that air may be sucked from the envelope so as to collapse the envelope material into contact with the weapon store 19. Folds of excess material 23 are folded against the store 19. The store 19 is supported on a simple stillage 24. The envelope 20 also includes a humidity indicator 25 to facilitate monitoring of the internal humidity.

Figure 5:
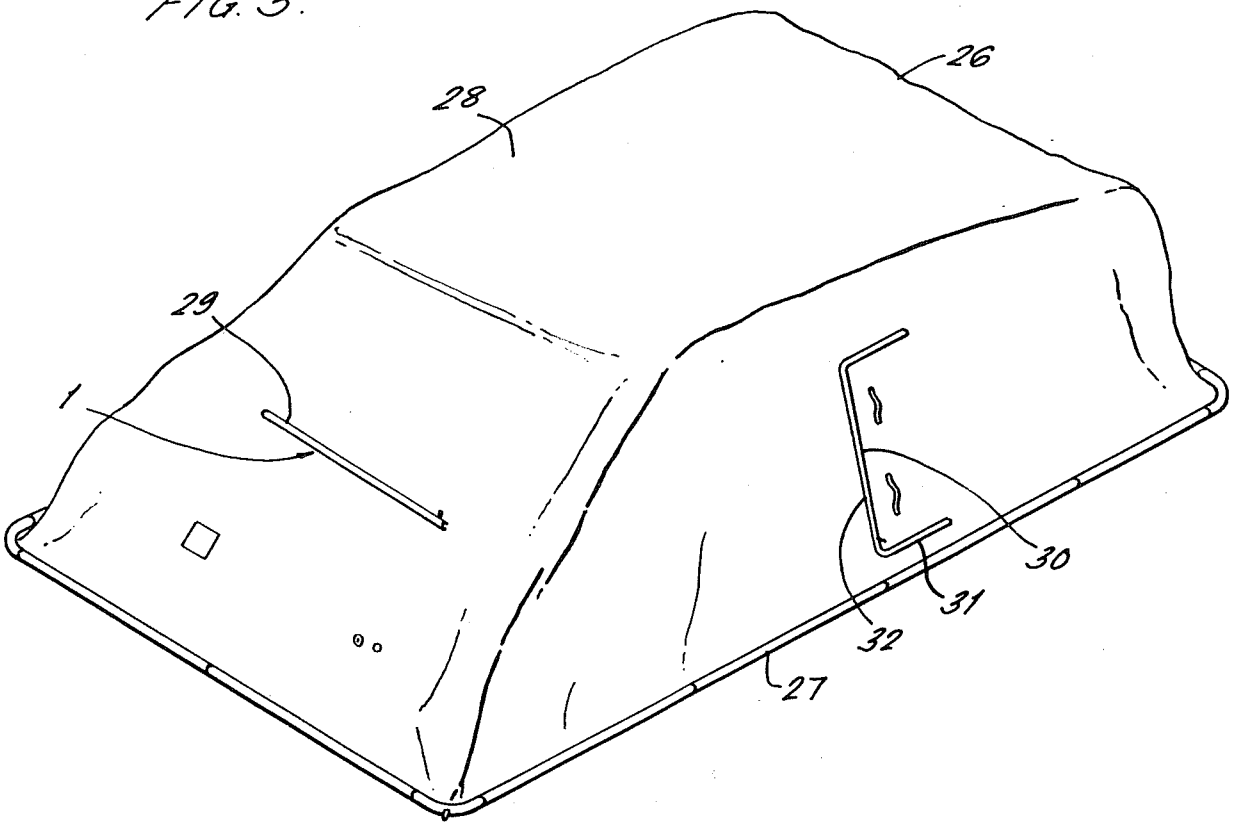

FIG. 5 shows a larger envelope 26 containing a vehicle. The envelope 26 has a rigid base 27 and an upper portion 28 of flexible material in which there are two slit openings 29 and 30.

The first of the slit openings 29 is a simple linear slit which is sealed by a seal 1 of the type hereinbefore disclosed. The second slit opening 30 describes three sides of a rectangle so as to form a flap opening or access port whereby access may be gained to the vehicle. The second slit opening 30 is similarly sealed by a seal 31 which is similar in cross section to the seal shown in FIG. 1 to 3 but includes a rigid member 32 which is formed in the same shape as the slit 30.

In use the seal shown in FIG. 1 extends lengthwise along a slit opening of an envelope (not shown) with the first sheet 6 secured along one slit edge and the second sheet 11 secured along the opposing slit edge. The flexible members may be bonded to the material adjacent to the slit edges or may be integrally formed with the material. The first and second flexible members 2 and 3 extend beyond the ends of the slit so as to form extended portions 17 along which the sheets 6 and 11 are bonded together. To close the slit opening the rigid member 4 is positioned along the slit with the valve 15 in alignment with the slotted aperture 16 and the first and second flexible members 2 and 3 are then brought together and are forced into the channel 5 through the constricted mouth 14. During insertion one or both of the flexible members 2 and 3 is resiliently deformed in thickness until the folded parts of the first and second sheets 6 and 11 respectively have passed beyond the mouth 14.

The tube 9 is then inflated by admitting air through the shrader valve 15 and as seen in FIG. 2 the inflated tube serves to urge the flexible members 2 and 3 into sealing engagement as they are compressed between the tube 9 and the internal surface 33 of the rigid member 4. The slit opening is thereby closed and sealed. Prior to inflation of the tube 9 the first and second flexible members 2 and 3 are retained within the channel 5 by virtue of the constricted mouth 14. This retaining means simplifies the alignment of the flexible members 2 and 3 prior to inflation and ensures that they do not accidently fall out or become trapped in the opening 14. The extended portions 17 throughout which the first and second flexible members 2 and 3 are bonded together serve to ensure that the sheets 6 and 11 remain uncrinkled at the ends of the slit so that a satisfactory seal is obtained upon inflation.

Such a seal 1 may be used with an envelope 20 comprising a flexible bag as shown in FIG. 4 in which a linear slit 21 provides a sufficiently large opening for an article such as the weapon store to be passed through the opening. The rigid member 4 may then be attached by insertion of the first and second flexible members 2 and 3 as described above and the tube 9 inflated to thereby seal the envelope 20. Air may then be evacuated from the envelope by means of the evacuation valve 22. It will be apparent that the envelope 20 or bag must necessarily be oversize rather than being a tight fit over the store to allow for insertion and removal and consequently this results in some excess folds 23 of flexible material being formed on evacuation of the envelope. It is therefore necessary to take care to neatly fold the excess folds 23 to avoid flapping of the folds during transport which might otherwise cause damage to the envelope 20 or to the store 19.

An advantage of using such a flexible envelope 20 is that a relatively simple stillage 24 may be used as opposed to alternative arrangements in which a dedicated stillage is incorporated into an enclosure specifically adapted for a store of a particular shape. Prior to insertion into the envelope 20 the store 19 may be lifted by virtue of its integrally formed lifting lugs 34. The slit 21 may be opened by deflation of the tube 9 and forced removal of the first and second flexible members 2 and 3 from the channel 5 so as to gain access to the lifting lugs 34 or for removal of the store 19 from the envelope 20.

The envelope may alternatively have flexible members which are integrally formed and conveniently such an envelope is constructed by starting from a suitably shaped sheet of elastomeric material, folding back and bonding edge portions of opposite edges of the sheet to form flexible members for use in a seal as disclosed above and bonding remaining edges of the sheet together so as to form an envelope having a slit opening bounded by the flexible members.

In the vehicle shelter shown in FIG. 5 the provision of sealable slit openings 29 and 30 simplifies the provision of access to the vehicle for regular servicing and removes the need for disturbing the main seal between the rigid base 27 and the flexible envelope 26.

I claim:

1. A seal for reusably sealing an opening formed by a slit in a sheet material portion of an envelope providing an airtight enclosure, which seal comprises an edge formation having first and second flexible members secured along respective first and second edge portions of the sit, a rigid member extending along the length of the slit and having a channel along its length for receiving and holding therein the first and second flexible members in contact with one another so as to close the opening, the channel having a mouth extending along its length and through which the first and second flexible members may be inserted or withdrawn, inflatable means operable upon inflation thereof to urge the first and second flexible members when so inserted into sealing engagement with one another and to secure the first and second members within the channel of the rigid member, and retaining means for resisting withdrawal of the first and second flexible members through the mouth of the channel whilst the inflatable means is deflated.

2. A seal as claimed in claim 1 wherein the retaining means is constituted by the channel having a mouth which is narrower than the combined thickness of the first and second flexible members so that insertion or withdrawal of the members to respectively close or open the opening requires resilient deformation of at least one of the flexible members.

3. A seal as claimed wherein the inflatable means comprises a flexible tube formed integrally with the first flexible member.

4. A seal as claimed in claim 3 wherein the first flexible member comprises a first sheet of flexible material and wherein the tube is formed by bonding an edge strip of the first sheet to a further strip inboard of the edge strip such that the thickness of the deflated tube is substantially three times the thickness of the first sheet.

5. A seal as claimed in claim 1 for use with a discontinuous slit having a first and second end wherein the first and second flexible members extend beyond the first and second ends respectively to form extended portions in which the flexible members are bonded to one another.

6. A seal as claimed in claim 1 including valve means for inflating or deflating the inflatable means, which valve means is accessible through an aperture in the rigid member.

7. An envelope including an opening sealable by means of a seal and having envelope valve means controlling an outlet of air from within the envelope whereby goods may be inserted through the opening, the opening may then be sealed and suction then applied to the envelope valve means so as to collapse the envelope into contact with the goods which seal comprises an edge formation having first and second flexible members secured along respective first and second edge portions of the slit, a rigid member extending along the length of the slit and having a channel along its length for receiving and holding therein the first and second flexible members in contact with one another so as to close the opening, inflatable means operable upon inflation thereof to urge the first and second flexible members into sealing engagement with one another and to secure the first and second members within the channel of the rigid member, and retaining means for resisting withdrawal of the first and second flexible members from the mouth of the channel whilst the inflatable means is deflated.

8. An envelope as claimed in claim 7 wherein the opening is formed by a discontinuous slit defining a flap enclosure for an access port of the enclosure.

9. A method of sealing an opening formed by a slit in a sheet material portion of an envelope providing an airtight enclosure including the step of applying an edge formation such that first and second flexible members of the formation are secured along respective first and second edge portions of the slit, which edge formation is co-operable with a rigid member to form a reusable seal, the rigid member extending along the length of the slit and having a channel along its length for receiving and holding therein the first and second flexible members in contact with one another so as to close the opening, and which seal further comprises inflatable means operable upon inflation thereof to urge the first and second flexible members into sealing engagement with one another and to secure the first and second members within the channel of the rigid member, and retaining means for resisting withdrawal of the first and second flexible members from the channel whilst the inflatable means is deflated.

10. A seal for reusably sealing an opening formed by a slit in a sheet material portion of an envelope providing an airtight enclosure, which seal comprises and edge formation having first and second flexible members secured along respective first and second edge portions of the slit and having a channel along its length for receiving and holding therein the first and second flexible members in contact with one another so as to close the opening, inflatable means comprising a flexible tube formed integrally with the first flexible member and operable upon inflation thereof to urge the first and second flexible members into sealing engagement with one another and to secure the first and second members within the channel of the rigid member, and retaining means for resisting withdrawal of the first and second flexible members from the channel whilst the inflatable means is deflated which retaining means is constituted by the channel having a mouth which is narrower than the combined thickness of the first and second flexible members so that insertion or withdrawal of the members so respectively close or open the opening requires resilient deformation of at least one of the flexible members, the first flexible member comprising a first sheet of flexible material and the tube is formed by bonding an edge strip of the first sheet to a further strip inboard of the edge strip such that the thickness of the deflated tube is substantially three times the thickness of the first sheet, and wherein the second flexible member comprises a second sheet of flexible material and is formed by bonding an edge strip of the second sheet to a further strip inboard of the edge portion such that the thickness of the member is substantially three times the thickness of the second sheet.

* * * * *